United States Patent [19]

Adahan

[11] 3,960,080

[45] June 1, 1976

[54] COMBINATION ROTARY PAPER CUTTER AND LOGO PRINTER

[75] Inventor: Carmeli Adahan, Berkeley, Calif.

[73] Assignee: The Singer Company, New York, N.Y.

[22] Filed: Feb. 12, 1975

[21] Appl. No.: 549,258

[52] U.S. Cl. ..... 101/291; 83/583; 101/69; 101/92; 101/117; 101/226; 101/288

[51] Int. Cl.[2] ..... B41F 3/82; B41F 13/60

[58] Field of Search ..... 83/583; 101/66, 69, 101/92, 288, 117, 224, 226, 288, 291

[56] References Cited

UNITED STATES PATENTS

| | | | |
|---|---|---|---|
| 901,996 | 10/1908 | Parker | 101/92 |
| 2,130,473 | 9/1938 | Ruau | 83/583 |
| 2,973,707 | 3/1961 | Crivelli | 101/66 |
| 2,996,001 | 8/1961 | Schlegel et al. | 101/228 |
| 3,099,212 | 7/1963 | Sohn | 101/226 |
| 3,196,781 | 7/1965 | Kuhnle et al. | 101/66 |
| 3,334,583 | 8/1967 | Adler | 101/92 |
| 3,376,811 | 4/1968 | Grintz | 101/288 |
| 3,452,627 | 7/1969 | Goodman et al. | 101/233 |
| 3,783,783 | 1/1974 | Hamisch, Sr. | 101/226 |
| 3,834,302 | 9/1974 | Canaiy | 101/69 |

*Primary Examiner*—Edgar S. Burr
*Assistant Examiner*—William Pieprz
*Attorney, Agent, or Firm*—Edward L. Bell; Joseph R. Dwyer

[57] ABSTRACT

A combined printer and cutter for simultaneously cutting and printing on a record media such as a paper tape for a customer receipt, including a stationary knife blade and a rotary knife blade which, upon rotation, severs the tape therebetween. Rocker arms are provided for rotating the rotary knife through its cutting operation and to drive the print head from a position against an ink source to a position against the record media simultaneously performing the cutting operation so as to print a trademark or other indicia on the record media concurrently therewith. The stationary knife is itself the printing platen and the rocker arms are mounted on the rotary knife so that all forces involved in oscillating the rotary knife and rotating the print head are taken by this relatively large shaft.

4 Claims, 12 Drawing Figures

FIG. 5
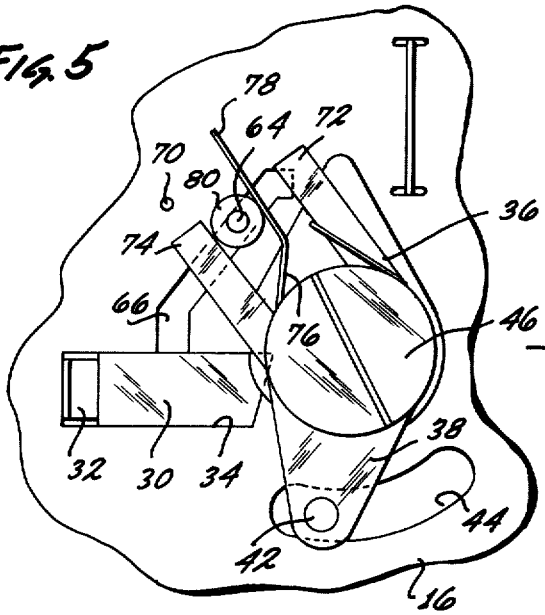
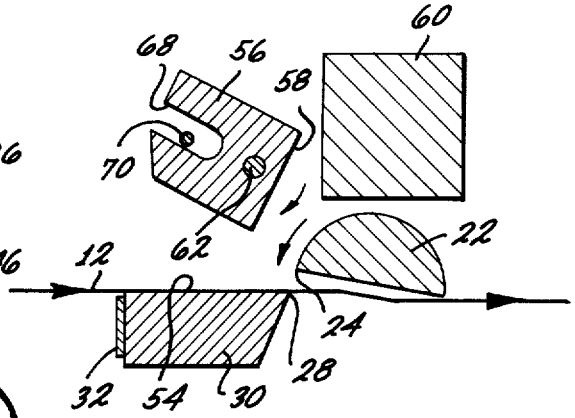
FIG. 5a
FIG. 6
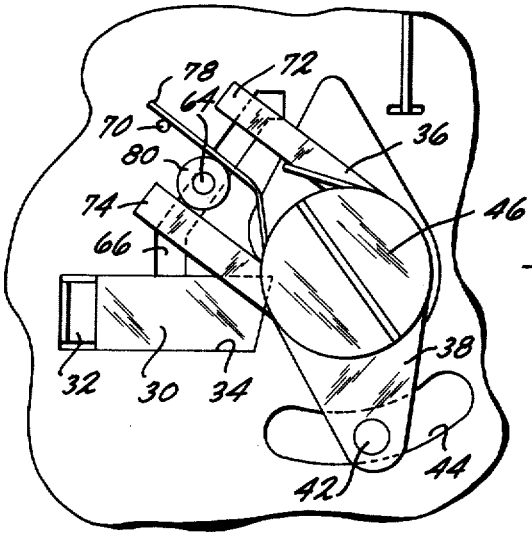
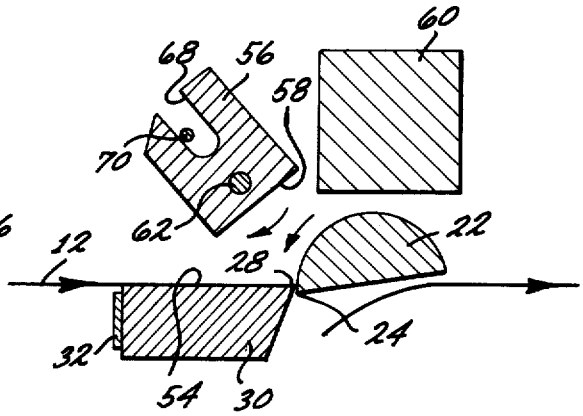
FIG. 6a

FIG. 7
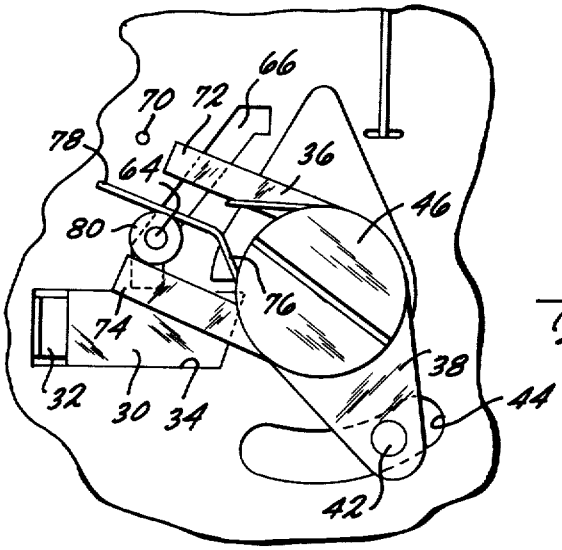
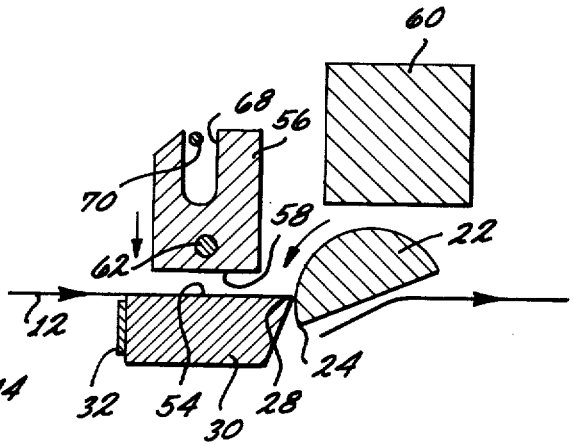
FIG. 7a
FIG. 8
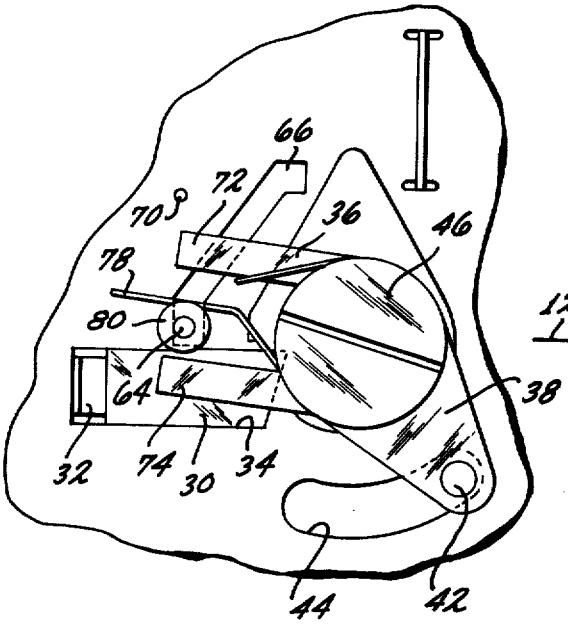
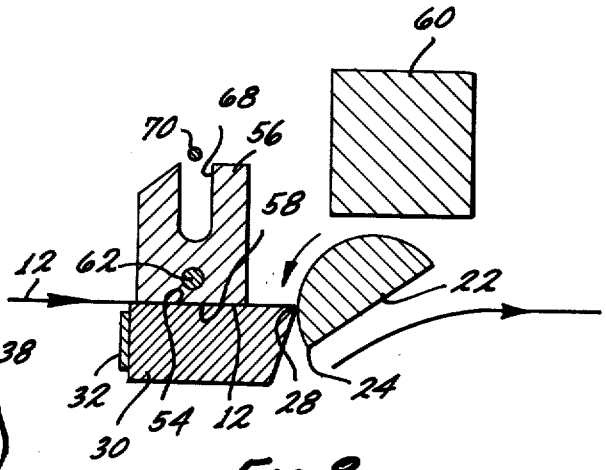
FIG. 8a

COMBINATION ROTARY PAPER CUTTER AND LOGO PRINTER

BACKGROUND OF THE INVENTION

1. Field of the Invention

This invention relates, in general, to printers and cutters for printing and cutting on a record media and, in particular, to the printing and cutting of paper tapes spooled off a roll commonly used in conventional or electronic point-of-sale data terminals where sales transactions are printed on the paper tape and cut for the purpose of providing a customer receipt. More specifically, this invention relates to the printing of a trademark or other indicia on the customer's receipt on which sales transactions are itemized and the cutting of this receipt so it may be handed to the customer.

2. Description of the Prior Art

Knife cutters for cutting paper tape rolled off a spool have been used in postal meters, as best described and claimed in the U.S. Pat. No. 3,062,133 to I. H. Lundquist et al, which issued on Nov. 6, 1972. In that patent, the knife cutter shown comprised a rotary cutter rod and a stationary knife blade which cut the paper transversely upon rotation of the rod. The rotary rod had a flat surface which formed the cutting edge and, as the rod was rotated with the paper therebetween, this cutting edge engaged the cutting edge of the stationary knife blade for the shearing effect. This patent also shows a printer on which the postage amount and rate is printed, but the printer is separate and apart from the cutter. Also, the printer prints on the tape after it has been severed from the remainder of the roll.

Another form of knife cutter for cutting paper tape, spooled off a roll and forming part of an electronic point-of-sale type data terminal, is best described and claimed in the U.S. Pat. No. 3,813,982 to Helmut K. Waibel, which issued on June 14, 1974. In that patent there was also disclosed a rotary cutter rod and a stationary knife blade, the latter of which was bowed and flexible and yielded upon rotation of the rotary knife to enhance the shearing effect and to make the two blades self-sharpening. Again, while there was a printer for recording transactions on the paper tape and also another printer (not disclosed in the patent) for printing a trademark or indicia on the tape, this latter printer does not form a part of the cutter nor does it coact with the cutter in the same manner as that of the present invention.

There are, of course, numerous other printers and cutters, some of which print and cut at the same time, such as those shown in the U.S. Pat. Nos. 2,973,707 and 1,177,493 to Crivilli and Cully, respectively, for printing tickets for railroads, street cars, and the like, but these mechanisms were not feasible for use in the present environment. These printers would print the entire ticket at the same time that the cutter was being actuated, whereas, in the present environment there are, in fact, two printers, one of which prints the sales transactions and other items on the paper tape which, of course, would be the equivalent of the printing of ticket matter in the instant patented devices, but there is still another printer which is utilized to print the trademark or other material on the receipt for handing the receipt to the customer. It is this latter type of printer and cutter to which the present invention is directed.

The printer and cutter for printing and cutting on record media, and specifically for printing of a trademark or other indicia on the customer's receipt on which sales transactions are itemized so that the receipt may be handed to the customer and which is an improvement over the abovementioned prior art comprises a rotary cutter which reacts with a stationary knife blade to provide the shearing of the paper tape disposed therebetween with a print head which moves from a position against an ink pad to a printing position concurrently with the cutting action. The means for actuating the print head is mounted on the rotary cutter for concurrent action therewith.

SUMMARY OF THE INVENTION

This invention comprises a combination printer and cutter, including a stationary knife blade and a rotary knife blade which, upon rotation, severs the record media therebetween. The means for rotating the rotary knife through its cutting operation also drives a print head which moves from an original position biased against an ink source to a position biased against the record media and return to its original position during the actuation of the rotary knife to perform the cutting operation so as to print a trademark or other indicia on the record media concurrently with the cutting operation. In this invention the means for rotating the rotary knife and drive the print head is mounted on the rotary knife to provide the concurrent movement.

BRIEF DESCRIPTION OF THE DRAWINGS

FIGS. 5—8 are partial detail views of the print head which, taken together with the schematic views of FIGS. *5a–8a* clearly show the travel of the print head during the concurrent printing and cutting operation.

DESCRIPTION OF THE PREFERRED EMBODIMENT

Figure 1:
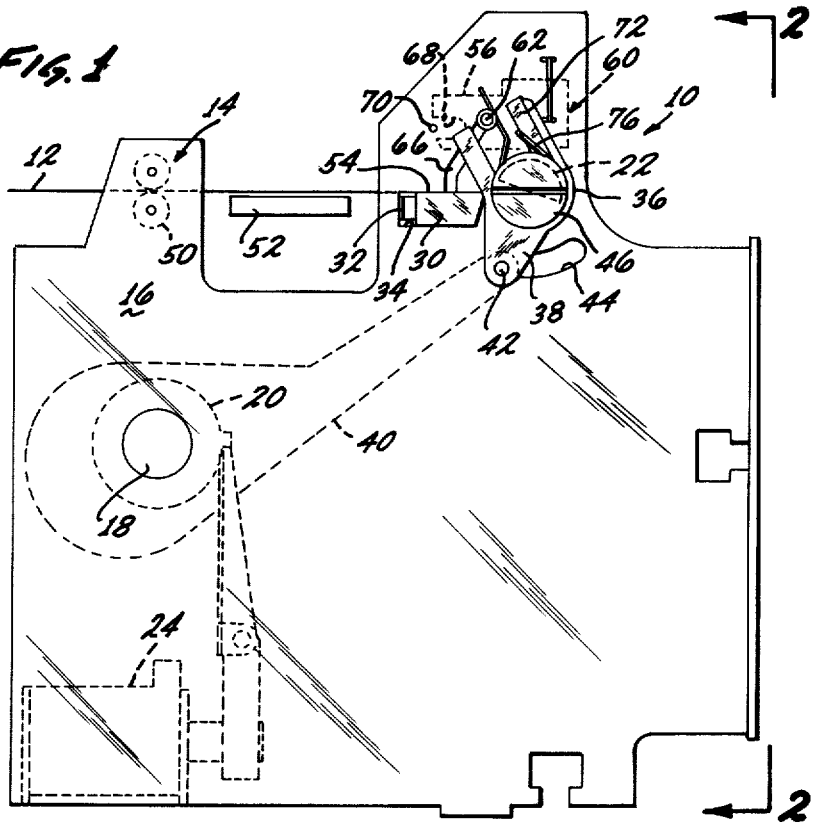
FIG. 1 is a side or elevational view illustrating the printer and cutter combination as used with a paper feed means and showing some details of a solenoid clutchactuating means.
Figure 2:
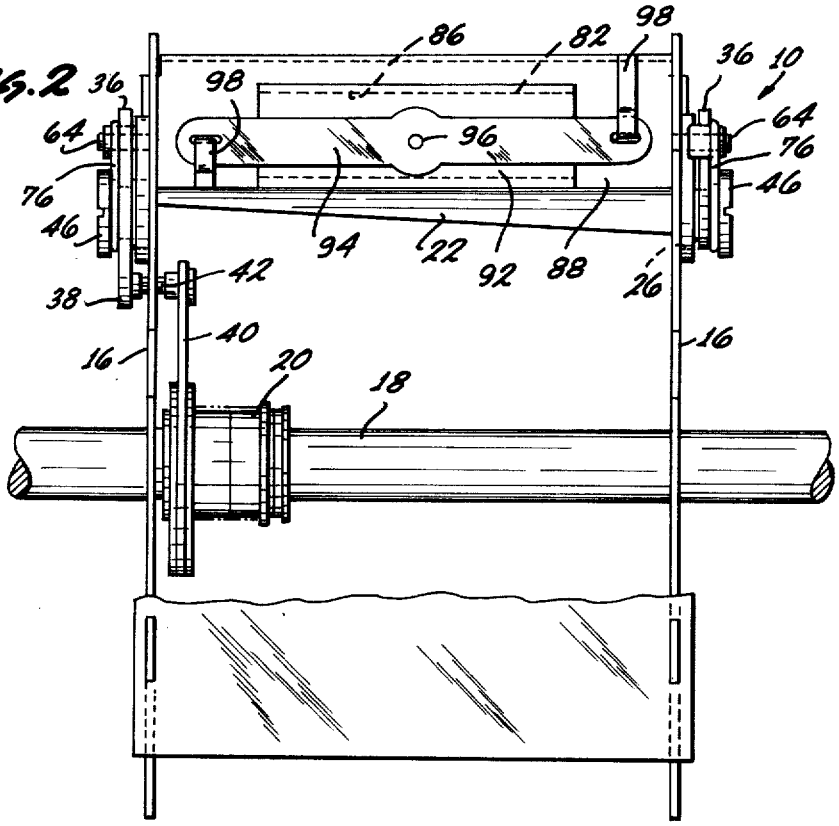
FIG. 2 is an end view taken along the lines 2—2 in FIG. 1.
Figure 4:
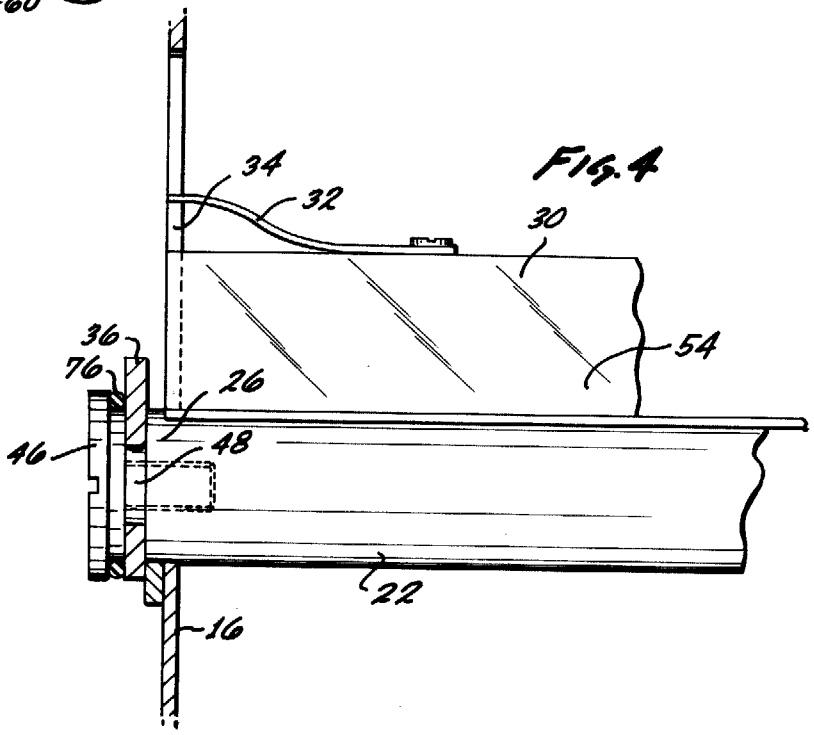
FIG. 4 is a partial top or plan view of the knife and cutter.

Turning now to the drawings, the printer and cutter combination constructed in accordance with the teachings of this invention, is indicated in its entirety as 10, to which record media (paper tape) 12 is fed by feeding means 14 from a roll (not shown), all of which are mounted between a pair of side plates 16. Though not shown, this entire combination forms part of an assembly, such as an electronic point-of-sale terminal, in which shaft 18 is the power source for a number of mechanisms, as well as for the feeding means 14 and the combination 10 through suitable solenoid clutch mechanisms, such as the one spring clutch shown at 20, operated by solenoid 24, intermittently engageable with the shaft 18 in response to timing devices which enable the feeding means 14 and the combination 10 at the desired timed intervals.

The cutter portion of the combination 10 comprises, in the embodiment shown, a rotary knife 22 having a curved cutting edge 24 formed by a helical surface cut as by milling the shaft 26 so that the edge 24 extends substantially the distance between the side plates 16. Shaft 26 extends through and is suitably journalled in the side plates 16, so the cutting edge may reciprocate about its longitudinal axis. Rotary cutting edge 24 is engageable with a cutting edge 28 of a stationary knife 30 which is biased by a suitable spring, one leaf being shown at 32, toward the rotary cutter. The stationary knife 30 extends from side plate to side plate in suitable slots 34 provided in the side plates 16 to permit sliding movement of the stationary knife toward the rotary cutter.

To reciprocate the rotary cutter, one pair of rocker arms 36 secured to the cutter shaft 26 (on the outside of side plates 16) is provided with an extension 38 which is pivotally attached to a crank 40 within the side plates by pin 42 which extends through the side plate 16. Plate 16 is provided with an arcuate slot 44 to permit the reciprocating motion of the rocker arm 36 and crank 40. To secure the rocker arms 36 to the shaft 26, the ends of the shaft are internally threaded to receive fastening nuts 46 and to prevent rotation between the rocker arms 36 and the shaft 26, both are also provided with complementary slots and fittings 48, both of which are shown only in FIG. 3. Crank 40 is, in turn, operatively connected to the spring clutch 20 mounted for operation on the main shaft 18. Thus, operation of the spring clutch 20 causes the main shaft 18 to rotate crank 40 which, in turn, reciprocates the rocker arm 36, reciprocating the rotary cutter, causing the shearing action with respect to the stationary knife.

In the embodiment shown, the paper tape 12 is normally fed by the rollers 50 which comprise the feeding means 14; the lower roller being coupled to the drive shaft 18 through the aforesaid clutches (not shown). The tape 12 is fed past a flat surface or platen 52 and over the top surface 54 of the stationary knife and through the space between the rotary knife edge and the stationary knife edge. The amount of tape fed by the rollers depends upon the number of transactions recorded thereon by a printer (not shown) cooperating with the surface or platen 52 in the point-of-sale terminal and then, at the appropriate time, usually at the end of the transactions and the total of the sales recorded, the rotary cutting edge will be reciprocated by actuation of the clutch 20 and the tape is cut by the shearing action between the rotary cutter and the stationary knife.

The printer portion of the printer and cutter combination 10 comprises a print head 56 which is an elongate bar extending substantially the length of the cutter blades and has, on one side, a printing face 58, more clearly shown in FIGS. 5*a*–8*a*, which face reciprocates between an ink pad 60 located above the rotary knife, and the paper tape 12 located on the top surface 54 of the stationary knife, which top surface 54 also forms the platen for printing purposes and will hereafter be referred to as such. The printing face 58 contains the trademark or other indicia, such as a logo, to be printed on the tape 12 disposed on the platen.

The print head 56 has a rod 62 located near the printing face which extends beyond the ends of the print head, as at 64, and extend through three-legged openings 66 or cam surfaces in the side plates 16, all of which interrelate as cam surfaces and cam followers when actuated by the rocker arms 36. The print head 56 also has a U-shaped groove 68 on the side opposite the printing face 58. The groove 68 opens toward a pivot pin 70 which is held stationary in suitable holes in the side plates 16.

Turning again to the rocker arms 36, it can be seen that each is bifurcated so that pairs of parallel arms 72, 74 are provided in which the ends 64 of the rod 62 are loosely held, since the bifurcations are larger in size than the diameter of the rods. This loose connection permits a small amount of travel of the rod relative to the arms 72, 74 since the rod is spring-biased against the forward arms 74 by suitable wire springs 76, wrapped around the cutter shaft 26, which have one leg 78 engaging a grommet 80 on the rod and the other end engaging the arm 72 so as to be responsive to the movement of the rocker arms. This biasing of the print head by the springs 76 provides a resiliency to the printing face 58 as it engages the tape 12 on the platen 54.

Since it becomes clear that the print head 56 is spring-biased in its printing position against the platen 54 to provide a suitable resiliency for printing purposes, it should also be pointed out that the print head is also spring-biased in its inking position.

Figure 3:
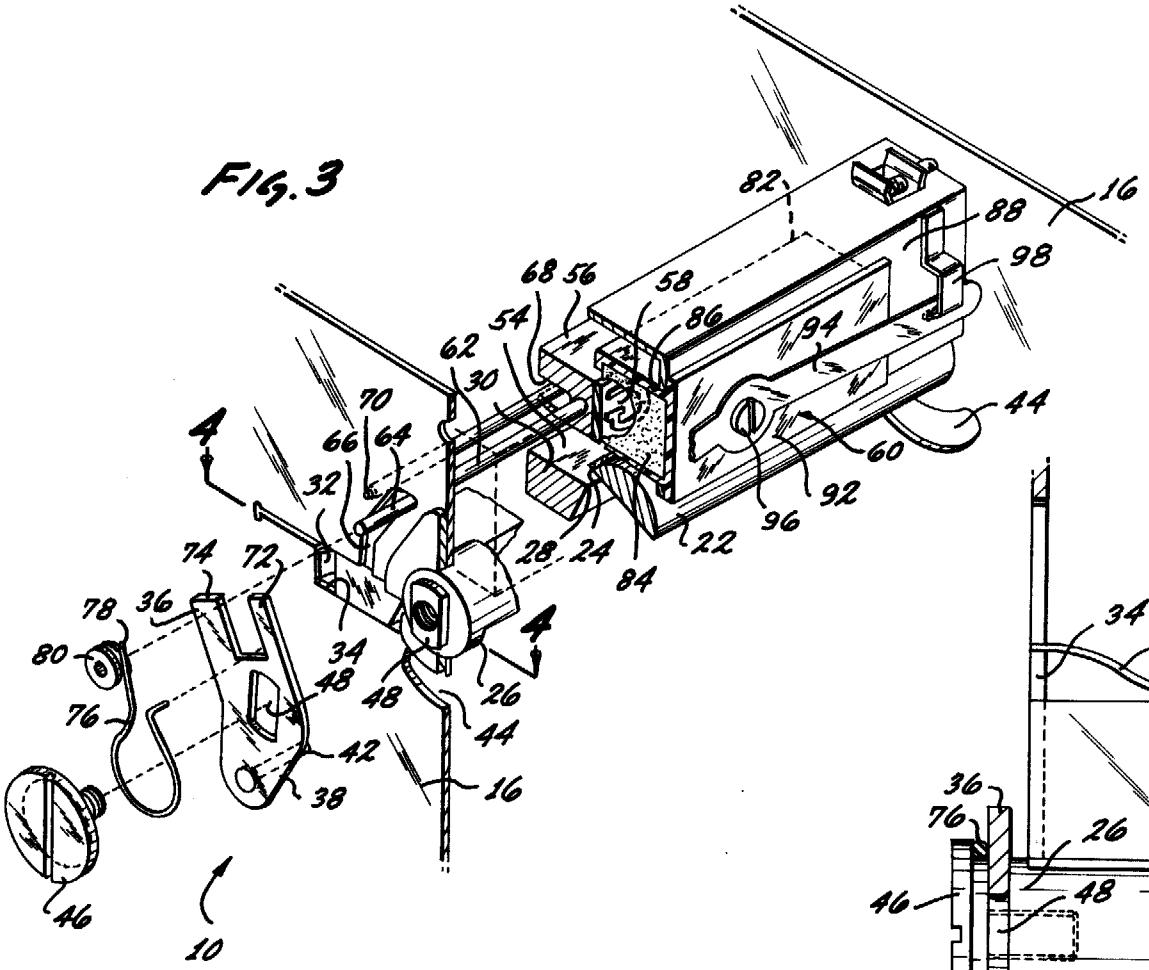
FIG. 3 is a perspective partially exploded view showing the details of the printer and cutter combination of FIGS. 1 and 2.

Turning specifically to FIG. 3, is can be seen that the ink pad, previously identified as 60, comprises an elongated box-like container 82 which opens toward the print head and in which is contained suitable inking pad 84. The container 82 fits into a suitable elongated aperture 86 in an angular cross piece 88 which extends and is anchored between the two plates 16. The container 82 is also provided with an integral back plate 92 which is larger than the aperture 86 in the angular cross piece and on which is provided a leaf spring 94. The leaf spring is attached to the back plate 92 by a suitable fastening screw 96 centrally of the back plate, and the ends engage suitable ears 98 attached to the cross piece 88. Ears 98 form an opening between the cross piece 88 and the ends of the ears to receive the ends of the leaf spring. To remove the ink pad 60, the leaf spring is rotated which removes its ends from the ears 98 and the container 82 then can be removed from the aperture 86. When the print head is in its inking position, however, such as shown in FIG. 3 and FIG. 1, the arm 74 of the rocker arm urges the print head 54 against the ink pad 84 within the container, the rocker arm being provided with a slight over-travel when the crank 40 is in the home position, such as shown in FIG. 1. This over-travel enables leaf spring 94 to react and also suitably inks the logo on the print face.

Turning now to FIGS. 5–8 and FIGS. 5*a*–8*a*, it can be seen that the print head 56 travels from a home or inking position, such as shown in FIGS. 1 and 3, cooperating with the pin 70 and the rocker arms 36 to a position such as in FIG. 8a where the print face 58 resiliently engages the tape 12 to print thereon. More specifically, movement of the rocker arm 36 by the crank 40 through one cycle, that is, one oscillation in the slots 44, causes the rocker arm 36, or more specifically, the link 78 of the spring 76, to move the camming portion 64 of the pin 62 along the three-legged slots 66. This causes the print head to first move away from the ink pad and then tilt about the pin 70 to the printing position and return in a reverse order to the ink pad. Concurrently therewith, the rotary knife 22 rotates so that the cutting edge 24 performs its shearing function with the cutting edge 28 on the stationary knife. Thus, both the printing and the cutting of the tape is performed concurrently (FIGS. 7*a* and 8*a* show the tape 12 being severed). Obviously, when the print head returns to its home position against the ink pad, the rotary knife is in a position to permit more tape to be moved between the opening between the two cutting edges so that the logo will be ready for the next receipt to be issued by the point-of-sale terminal.

Finally, it should also again be pointed out that since the shaft 26 forming the rotary knife is the largest and is journalled in the large opening in the side plates 16, all of the moment involved in the oscillation of the crank 40 for rotating the knife and the print head is taken by this large shaft, thus providing rigidity and long life to the combined printer-cutter operation.

What is claimed is:

1. The combination printer and cutter of record media comprising:

a stationary knife blade having a cutting edge and a platen therein, a shaft with a rotary knife blade having an edge which engages the cutting edge of the stationary knife blade and which upon rotation severs record media therebetween, said stationary knife blade edge being springbiased toward said rotary knife blade edge, actuating means for rotating said rotary knife edge, means for printing on said record media operable by said actuating means, both said rotary knife blade and said printing means being mounted to rotate about parallel axes, and said printing means being movable from non-printing position to a printing position in engagement with said platen on said stationary knife blade while said actuating means is rotating said rotary knife edge to cut said record media.

2. The combination as claimed in claim 1 wherein inking means is disposed to ink said printing means when the latter is in said non-printing position.

3. The combination printer and cutter of record media comprising:

a cutter portion and a printer portion, said cutter portion including a stationary knife blade and a rotary knife blade, each having a cutting edge which are engagable with each other and which upon rotation of said rotary knife blade cuts record media disposed therebetween, said printing portion including a print head for printing upon said record media while said record media is being severed in said cutting portion and an inking means, said print head being oscillatable from said inking means into engagement with record media disposed in contacting relationship on said stationary knife blade of said cutting portion for printing on said record media disposed in said cutting portion, and actuating means for oscillating said printing head and rotating said rotary knife concurrently about parallel axes.

4. The combination printer and cutter as claimed in claim 3 wherein said rotary knife blade forms part of a shaft which is connected to said actuating means to be actuated thereby.

* * * * *